US005180005A

United States Patent [19]

Marsais et al.

[11] Patent Number: 5,180,005

[45] Date of Patent: Jan. 19, 1993

[54] DEVICE FOR MOUNTING TWO PIPE CONNECTIONS ON TWO ADJACENT APERTURES OF A HEAT EXCHANGER CASING

[75] Inventors: Christian Marsais, Epernon; Frédéric Letrange, Nanterre, both of France

[73] Assignee: Valeo Thermique Moteur, Le Mesnil-Saint-Denis, France

[21] Appl. No.: 900,574

[22] Filed: Jun. 18, 1992

[30] Foreign Application Priority Data

Jun. 19, 1991 [FR] France ..... 91 07543

[51] Int. Cl.[5] ..... F28F 9/00

[52] U.S. Cl. ..... 165/178; 165/78; 165/916; 285/93; 285/137.1; 285/205

[58] Field of Search ..... 165/78, 178, 916, 76; 285/93, 205, 137.1, 360, 361, 376, 396, 401, 402

[56] References Cited

U.S. PATENT DOCUMENTS

| | | | |
|---|---|---|---|
| 833,025 | 10/1906 | Connolly | 285/137.1 |
| 4,271,901 | 6/1981 | Buchmüller | 165/165 |
| 4,967,835 | 11/1990 | Lefeber | 165/167 |
| 5,022,461 | 6/1991 | Potier et al. | 165/76 |
| 5,062,478 | 11/1991 | Potier et al. | 165/178 |

FOREIGN PATENT DOCUMENTS

| | | | |
|---|---|---|---|
| 0106783 | 1/1987 | European Pat. Off. . | |
| 0359657 | 9/1989 | European Pat. Off. . | |
| 3810385 | 3/1989 | Fed. Rep. of Germany | 285/137.1 |
| 2551852 | 3/1985 | France . | |
| 2588367 | 4/1987 | France | 165/178 |
| 174426 | 1/1922 | United Kingdom | 285/137.1 |

*Primary Examiner*—Allen J. Flanigan
*Attorney, Agent, or Firm*—Morgan & Finnegan

[57] ABSTRACT

A heat exchanger has a casing formed with two adjacent apertures to which two tubular pipe connections are secured.

The apertures in the casing are so configured as to act as one half of a bayonet fitting, the other half of each bayonet fitting being a bayonet end portion fixed to each pipe connection. These bayonet end portions are adapted to be put into a locking position on the apertures, and are provided with base portions which are configured according to the spacing between the two apertures. The base portions have stop means which are arranged to cooperate with each other to lock the end portions in position when both of the latter are in their locking position. The invention is especially applicable to motor vehicle engine oil coolers.

9 Claims, 2 Drawing Sheets

DEVICE FOR MOUNTING TWO PIPE CONNECTIONS ON TWO ADJACENT APERTURES OF A HEAT EXCHANGER CASING

FIELD OF THE INVENTION

This invention relates to a securing device for securing two tubular pipe connections on two apertures, adjacent to each other, of a heat exchanger, in particular a heat exchanger intended for cooling lubricating oil for a motor vehicle engine.

BACKGROUND OF THE INVENTION

In heat exchangers of this type, the two tubular pipe connections serve respectively as the inlet and the outlet for a liquid, generally a mixture of glycol and water, for cooling the oil, with the latter flowing into a chamber mounted in the interior of the housing and generally consisting of a stack of pairs of half plates. Up to the present time, the two tubular pipe connections have been brazed or welded on to the corresponding apertures of the casing, which involves making a heat exchanger of such a size as to be inconvenient, especially in the case where the pipe connections are of bent configuration. In addition, fitting of the pipe connections necessitates a brazing or welding operation, and therefore requires an additional manufacturing step.

DISCUSSION OF THE INVENTION

A main object of the invention is to overcome the above mentioned drawbacks.

To this end, according to the invention there is provided a device for the fastening of two tubular pipe connections on two adjacent apertures of a casing of a heat exchanger, characterised in that the apertures are configured with a bayonet-type fitting, in that the pipe connections include respective bayonet end portions adapted to be put into a locking position on the apertures, and in that the two end portions are provided with base portions which are configured according to the spacing between the apertures and which include stop means adapted to cooperate with each other when the end portions are both in the locking position.

In this way the fitting of the two tubular pipe connections is particularly simple and rapid, because the latter are carried by bayonet-type support means, and because retention of the two end portions in the locking position is obtained by virtue of stop means with which the base portions are provided. This prevents the pipe connections from being unlocked accidentally.

The device according to the invention enables pipe connections of different shapes to be secured to the heat exchanger while, in particular, smaller pipe connections of bent configuration can be used than is the case in the prior art where the pipe connections had to be brazed or welded in position.

According to a preferred feature of the invention, the two bayonet end portions are arranged to be put into the locking position in their respective apertures by rotation in opposite directions through a fraction of a turn.

Preferably, the two bayonet end portions are arranged to be put into the locking position in their respective apertures by rotation through a quarter of a turn.

According to another preferred feature of the invention, the base portion of one of the bayonet end portions includes a guideway in the form of an arc of a circle terminating in a stop surface, and the base portion of the other bayonet end portion includes a flexible lug having a free end which, during rotation of the said other end portion, is arranged to pass forcibly over the guideway until it becomes lodged against the stop surface, the first said end portion being already in the locking position.

Thus, after the first end portion has been put into its locking position, it is then only necessary to insert the other end portion into its corresponding aperture in the casing, and to rotate it so as to put it in its locking position, in which the stop means of the two end portions cooperate with each other so as to resist any unlocking of the two end portions.

The flexible lug is preferably non-radial.

According to a further preferred feature of the invention, each of the respective base portions of the two bayonet end portions comprises a groove receiving a sealing ring adapted to be compressed between the base portion and the casing.

One of the base portions may have a lateral extension formed with a locating notch, which may for example be used for fastening the lubricating oil heat exchanger on to the engine casing of the vehicle.

Preferably, each of the tubular pipe connections is formed as a single piece, with its base portion and its bayonet end portion, by moulding in a plastics material which may for example be of the polyamide type.

In preferred forms of heat exchanger in accordance with the invention, each of the tubular pipe connections is of bent configuration, which enables the size of the whole to be further reduced.

A preferred embodiment of the invention will be described below, by way of example only and with reference to the accompanying drawings.

DESCRIPTION OF A PREFERRED EMBODIMENT OF THE INVENTION

Figure 1:
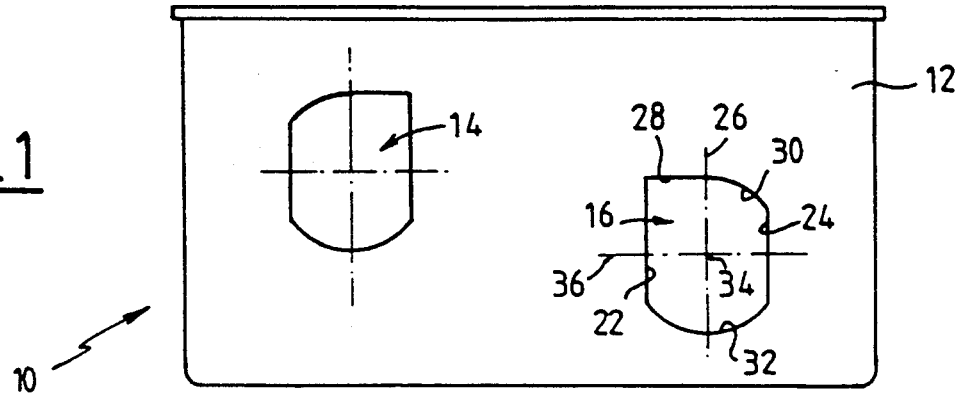
FIG. 1 is a plan view of a casing of a heat exchanger having two adjacent apertures formed in accordance with the invention.

Reference is first made to FIG. 1, which shows a casing 10 of a heat exchanger. In this example, the latter is a radiator for cooling the lubricating oil of a motor vehicle engine. The casing 10 has a wall 12 through which two adjacent apertures 14 and 16 are formed. Each of these apertures is configured for a bayonet type fixing.

The apertures 14 and 16 are adapted for two tubular pipe connections 18 and 20 (FIGS. 2 and 3) to be secured to the respective apertures 14 and 16, the pipe connections 18 and 20 being carried on the casing 10. In this example, the pipe connections 18 and 20 serve as an inlet and an outlet for a liquid, such as a glycol and water mixture for cooling the oil. This coolant liquid flows into a chamber (not shown) mounted within the interior of the casing 10. This chamber, which may for example consist of a stack of pairs of half plates, is traversed by the oil, which flows in a closed circuit and which enters and leaves the chamber through two connecting conduits (not shown) which pass in a sealing manner through another wall of the casing 10.

The apertures 14 and 16 have symmetrical shapes, in order (as will be seen further on in this description) to secure the two pipe connections 18 and 20 by respective rotations in opposite directions, through a quarter of a turn in each case.

Figure 7:
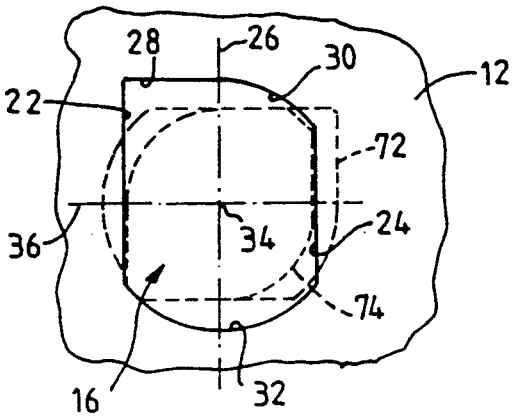
FIG. 7 is a plan view of one of the apertures of the casing.

As shown in FIGS. 1 and 7, the aperture 16 is delimited by two parallel edges 22 and 24 of unequal lengths. The two edges 22 and 24 are equidistantly disposed on either side of an axial plane 26 of the aperture. The latter is further delimited by an edge 28, which is joined at right angles to the edge 22 and which extends as far as the axial plane 26. This edge 28 is extended by a further edge 30 in the form of an arc of a circle, which is joined to the edge 24. The edges 22 and 24 are also joined together through a further edge 32 having the shape of an arc of a circle, this circle having the same radius as that defining the edge 30. The two arcuate edges 30 and 32 have a common centre 34, lying at the intersection of the axial plane 26 and a further axial plane 36 at right angles to the plane 26.

Figure 3:
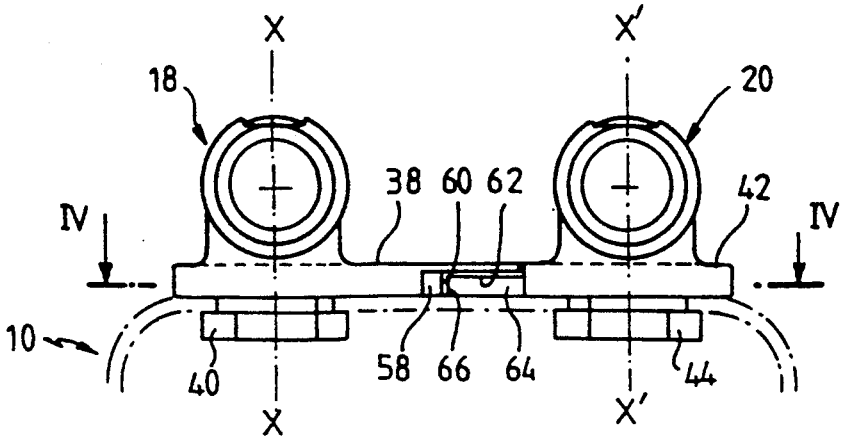
FIG. 3 is a side view of the casing of FIG. 2.

The tubular pipe connection 18 in this example has a right angle bend, and is formed integrally with a base portion 38 and with a bayonet end portion 40. The base portion 38 is arranged to bear against the wall 12 of the casing, while the bayonet end portion 40 has a configuration adapted to that of the aperture 14. Similarly, the tubular pipe connection 20 is also formed with a right angle bend and is formed integrally with a base portion 42 and a bayonet end portion 44, the base portion 42 being arranged to bear against the wall 12 on the outside of the casing 10, with the bayonet end portion 44 having a shape adapted to that of the aperture 16. The bayonet end portions 40 and 44, as can be seen in FIG. 3, have symmetrical structures enabling the pipe connections 18 and 20 to be secured in position by rotation in opposite directions through a quarter of a turn.

Figure 2:
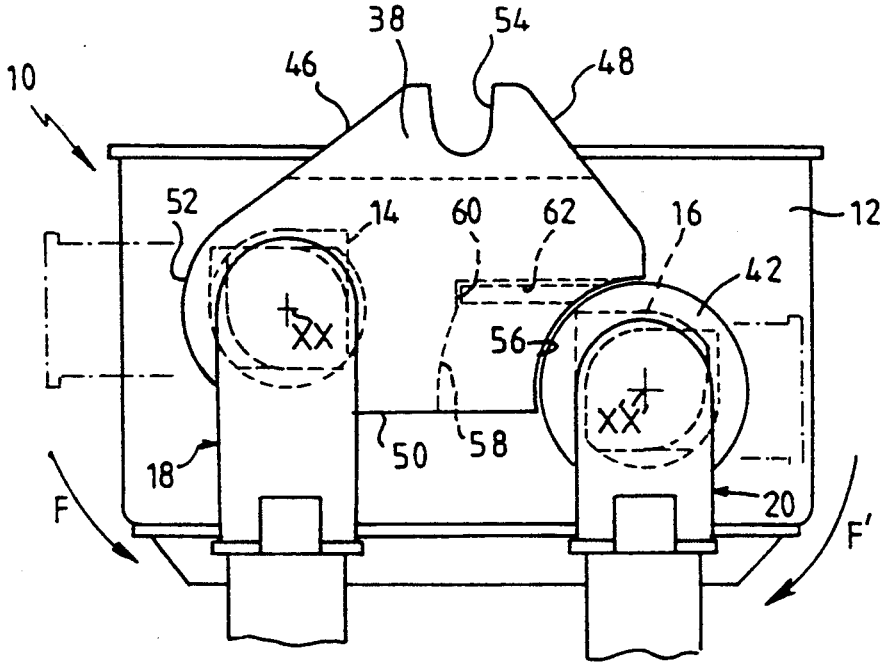
FIG. 2 is a view similar to that of FIG. 1 and showing the same casing, with two tubular pipe connections locked in position thereon.

As can be seen in FIG. 2, fitting of the tubular pipe connection 18 is carried out by rotation through a quarter of a turn in the anti-clockwise direction, from an insertion position (indicated in phantom lines) to a locking position which is indicated in full lines. Fitting of the other tubular pipe connection, 20, is carried out by rotation of the latter through a quarter of a turn in the clockwise direction, again from an insertion position shown in phantom lines to a locking position shown in full lines. In this example the tubular pipe connections 18 and 20 extend in directions that are substantially parallel to each other in their locking positions.

The tubular pipe connection 18, with its base portion 38 and its securing end portion 40 is preferably formed by moulding in one piece from a plastics material, which may for example be of polyamide type. The same is true for the tubular pipe connection 20, with its base portion 42 and its bayonet end portion 44.

The base portions 38 and 42 are configured according to the spacing between the apertures 14 and 16, and are provided with stop means adapted to cooperate with each other when the bayonet end portions 40 and 44 are both in the locking position, so as to resist unlocking of the two base portions, and consequently to resist unlocking of the two pipe connections 18 and 20 from the casing 10.

The end portion 40 of the pipe connection 18 defines an axis of rotation XX, and the corresponding base portion 38 is made in the form of a generally asymmetrical flat plate which extends at right angles to the axis XX. The base portion 38 is generally in the form of a triangle defined by three straight edges 46, 48 and 50. The edges 46 and 50 are joined together through an edge portion 52 in the form of an arc of a circle centred on the axis XX. The edges 46 and 48 are joined together through an edge portion 54 defining a notch which serves, for example, to locate the base portion 38 on the engine casing of the vehicle. Finally, the edges 48 and 50 are joined together through an edge portion 56 in the form of an arc of a circle, which in the locking position of the tubular pipe connection 18 is centred on the axis of rotation X'X' of the pipe connection 20. In this locking position, the edge portion 56 abuts against the base portion 42 of the pipe connection 20, which is generally circular in shape, being centred on the axis X'X'.

The base portion 38 is relieved over part of its thickness to define a guideway 58 in the form of an arc of a circle (FIGS. 2 to 4) which, in the locking position of the tubular pipe connection 18, is centred on the axis X'X'.

The guideway 58 extends from the edge 50 of the base portion, to a stop surface 60 which is in the form of a straight edge extending at right angles to the edge 50 and parallel to the axial plane 26 of the aperture 16 (in the locking position of the pipe connection 18). The stop surface 60 is joined at right angles to an abutment edge 62, which extends parallel to the edge 50 of the base portion 38 and which terminates in the edge portion 56 of the latter.

Figure 4:
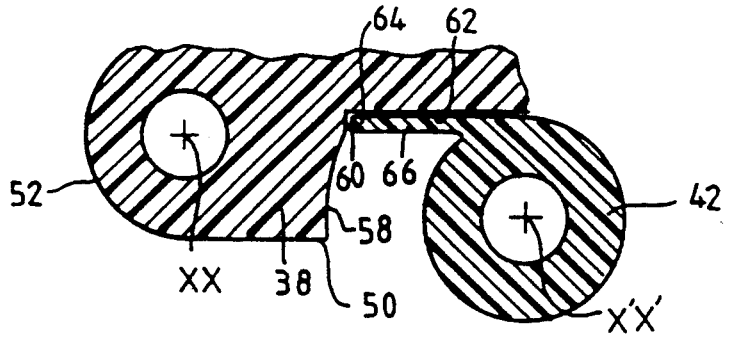
FIG. 4 is a view in cross section taken on the line IV—IV in FIG. 3.
Figure 5:
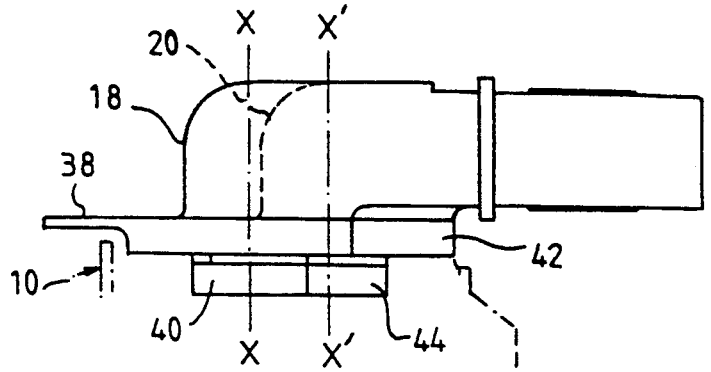
FIG. 5 is a side view of a tubular pipe connection.

The base portion 42 of the pipe connection 20 includes a flexible lug 64, seen in FIGS. 2 to 4, which extends in a non-radial direction with respect to the axis X'X'. The lug 64 terminates in a free end 66 which is arranged to cooperate with the guideway 58 and the stop surface 60 when the pipe connection 18 has been put into its locking position.

Thus, the tubular pipe connection 18 is first fitted by inserting the end portion 40 through the aperture 14, and rotating the pipe connection through a quarter of a turn in the anti-clockwise direction as indicated by the arrow F in FIG. 2. The pipe connection 20 is then fitted by inserting its bayonet end portion 44 through the aperture 16 and then rotating it through a quarter of a turn in the clockwise direction as indicated by the arrow F'. During this rotational movement, the free end 66 of the flexible tongue 64 is forced against the guide surface 58, over which it passes until it finally becomes lodged against the stop surface 60, while also coming into abutment against the edge 62. In this position, the two pipe connections 18 and 20 are locked in position, and cooperation between the stop surface 62 and the flexible tongue or lug 64 resists any accidental unlocking of the two pipe connections 18 and 20.

Figure 6:
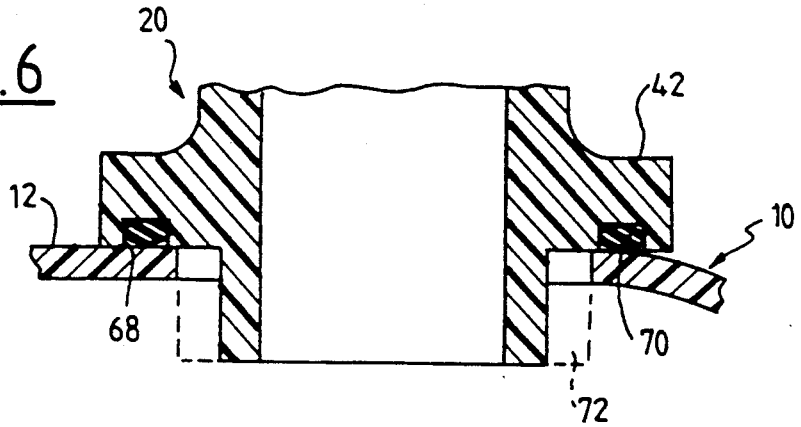
FIG. 6 is a view in axial cross section of the base portion and bayonet end portion of a tubular pipe connection.

Referring now to FIG. 6, each of the base portions (in the example shown the base portion 42) has an annular groove 68 which is centred on the axis of rotation of the base portion, that is to say in this case the axis X'X'. This groove 68 contains a sealing O-ring 70 which becomes compressed between the base portion 42 and the casing 10 so as to seal the fastening of the former to the latter.

Figure 8:
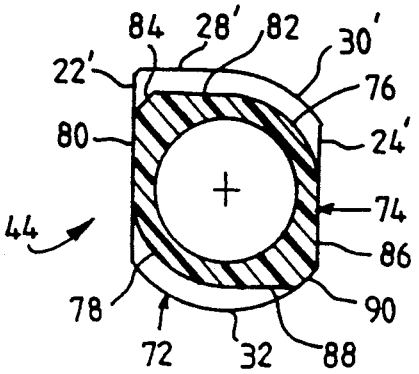
FIG. 8 is a view in transverse cross section of a bayonet end portion adapted to the aperture shown in FIG. 7.

Reference is now made to FIGS. 7 and 8 in order to describe in greater detail the cooperation between the bayonet end portion 44 and the corresponding aperture 16 of the casing, it being noted that the configuration of the end portion 40 and the corresponding aperture 14 are symmetrical.

The bayonet end portion 44 (see FIG. 8) includes a retaining flange 72, the form of which is such that it can just pass through the aperture 14. The flange 72 is delimited by edges 22', 24', 28', 30' and 32', which correspond respectively to the edges 22, 24, 28, 30 and 32 of the aperture 16. The flange 72 is joined to the base portion 42 through an intermediate section 74 which is shown in cross section in FIG. 8. The section 74 is delimited by two opposed edges 76 and 78, each in the form of a quarter of a circle centred on the axis X'X' and having a smaller radius than the edges 30' and 32' of the flange 72. The edges 76 and 78 are joined together on one side through a straight edge 80 which partly coincides with the edge 22', and also by a further straight edge 82 which extends parallel to the edge 28'. The edges 80 and 82 are joined together through a cut edge 84. On the other side, the edges 76 and 78 are joined together through a straight edge 86 which is partly coincident with the edge 24' of the flange, and by a straight edge 88 which extends at right angles to the edge 86 and which is joined to the latter through a short edge 90 in the form of an arc of a circle.

After the flange 72 has been inserted through the aperture 16 in the axial direction XX', the end portion is rotated through a quarter of a circle in the direction of the arrow F', until it reaches the locking position indicated in broken lines in FIG. 7. At the end of this rotation, the edges 82 and 86 of the section 74 come into abutment respectively against the edges 24' and 22' of the aperture 16, which stops the rotation of the end portion.

The invention is of course not limited to the embodiment specifically described above and shown in the drawings. It also extends to other variants within the scope of the invention. For example, the tubular pipe connections may be designed to be fitted either on a common wall of the casing or on two adjacent walls defining an angle between them. Equally, fastening of the pipe connections may be obtained with the use of other types of bayonet fitting, either by rotation in opposite directions as in the example described, or by rotation in the same direction.

What is claimed is:

1. A housing for a heat comprising a casing defining two through apertures adjacent to each other and two tubular pipe connections, the pipe connections and the casing together defining securing means for securing the pipe connections on the casing, wherein each said pipe connection comprises a bayonet end portion for engagement in a respective said aperture, each of the said apertures being configured for bayonet type cooperation with the corresponding bayonet end portion so as to constitute with the latter the fastening means, each bayonet end portion comprising a base portion configured according to the spacing between the said apertures in the casing and defining stop means, the bayonet end portions being adapted to be put into a locking position in relation to the apertures, such that the stop means of the two base portions cooperate with each other when both bayonet end portions are in the locking position.

2. A housing for a heat exchanger according to claim 1, wherein the two bayonet end portions are adapted to be inserted into the respective said apertures and then rotated through a fraction of a turn in opposite directions to lock them in their respective apertures.

3. A housing for a heat exchanger according to claim 1, wherein the two bayonet end portions are adapted to be inserted into their respective said apertures and then locked in the latter by rotation, through a quarter of a turn.

4. A housing for a heat exchanger according to claim 1, wherein a first said base portion defines a stop surface and a guideway in the form of an arc of a circle terminating at said stop surface, the second said base portion comprising a flexible lug defining a free end for forcible engagement against the guideway, whereby when the bayonet end portion associated with the second base portion is rotated to lock the associated tubular pipe connection in position, the pipe connection associated with the first base portion being already in its locking position, the flexible lug, pressing on the guideway, passes over the latter to come into final engagement against the stop surface.

5. A housing for a heat exchanger according to claim 4, wherein the flexible lug is non-radial.

6. A housing for a heat exchanger according to claim 1, wherein each said base portion defines a groove, and further including a sealing ring received in each said groove so as to be compressed between the associated said base portion and the casing.

7. A housing for a heat exchanger according to claim 1, wherein one said base portion defines a locating notch.

8. A housing for a heat exchanger according to claim 1, wherein each said tubular pipe connection, together with the associated base portion and bayonet end portion, are formed integrally with each other in a plastics material.

9. A housing for a heat exchanger according to claim 1, wherein each said tubular pipe connection is configured with a bend.

* * * * *